US006694646B2

(12) United States Patent
Messmer et al.

(10) Patent No.: US 6,694,646 B2
(45) Date of Patent: Feb. 24, 2004

(54) SNOWSHOE HARNESS

(75) Inventors: Nathan J. Messmer, San Francisco, CA (US); Dierdre O'Mara, San Francisco, CA (US)

(73) Assignee: Winterquest LLC, Stowe, VT (US)

( * ) Notice: Subject to any disclaimer, the term of this patent is extended or adjusted under 35 U.S.C. 154(b) by 0 days.

(21) Appl. No.: 10/039,168

(22) Filed: Jan. 4, 2002

(65) Prior Publication Data

US 2003/0126766 A1 Jul. 10, 2003

(51) Int. Cl.[7] ..... A43B 5/04
(52) U.S. Cl. ..... 36/122; 36/124; 36/7.7
(58) Field of Search ..... 36/122, 123, 124, 36/125, 7.2, 7.7, 7.5, 7.6, 59 R, 62

(56) References Cited

U.S. PATENT DOCUMENTS 4,259,793 A * 4/1981 Morgan et al. ..... 36/125
4,353,172 A * 10/1982 Bryant ..... 36/7.6
5,259,128 A * 11/1993 Howell ..... 36/122
5,687,491 A 11/1997 Klebahn
5,787,612 A * 8/1998 Mahoney et al. ..... 36/124
5,918,387 A * 7/1999 Emerson ..... 36/122
6,256,908 B1 * 7/2001 Warner ..... 36/124

* cited by examiner

*Primary Examiner*—M. D. Patterson

(57) ABSTRACT

A harness for a snowshoe has straps, buckles and strap slip connections configured such that a single pull will snug the harness down to the boot, both at the toe and at the top of the arch, firmly engaging over the shoe or boot. The straps, which may be formed as a single strap, extend up from one side of the toe end of a footbed secured to the snowshoe, and pass through loops and buckles of the harness assembly in such a way that the ends of the straps, or a loop of the single strap can be pulled from between the buckles to tighten the harness at toe and arch areas simultaneously. Mechanical advantage preferably is provided at the toe end, by the strap looping back once before it reaches the buckle. The strap or straps are arranged and connected such that a flexible harness shell that extends up from one side of the footbed "floats" in position, accommodating a wide range of shoe or boot sizes.

26 Claims, 1 Drawing Sheet

SNOWSHOE HARNESS

BACKGROUND AND SUMMARY OF THE INVENTION

The invention is an improved binding for a snowshoe, to make engagement of the binding convenient and reliable for the user.

Snowshoe bindings have taken a number of different forms. See, for example, Atlas Snowshoe Company U.S. Pat. Nos. 5,687,491 and 5,918,387. Those patents show strap bindings where the straps pass through adjustment buckles, requiring adjustment of tension in the straps over the shoe, sometimes also the joining of a buckle connection, as well as the engagement of a heel strap.

The straps described above have often been employed along with some form of harness shell capable of engaging around part of the shoe and with sufficient flexibility to generally conform to the shoe. Again, see Atlas U.S. Pat. No. 5,918,387. Such a shell was effective on some snowshoes to minimize direct contact between the straps and the shoe.

The snowshoe binding of this invention makes several important improvements over prior snowshoe bindings. The binding of the invention enables a user to pull a single strap loop or handle to effect adjustment and tightening of straps over both the toe area and the arch area of the foot simultaneously. A harness shell is included, extending up from a footbed on one side, and a further harness element is provided on the opposite side, and the straps engage with these harness components in such a way as to allow the harness shell to "float" over the boot and find the optimum position over the boot for securely and comfortably engaging the boot. The arch of the boot, at bottom and up the side, is firmly engaged by a band of the harness element, providing stability and resisting boot rotation.

In a preferred embodiment a single strap provides both strap securements, at toe and arch, and the toe securement has a loop-over return in the strap to provide mechanical advantage in addition to that provided by the slip-through type locking buckle preferably used.

The binding or harness of the invention thus provides for a single tug on a strap loop to snug the harness down to the boot, both at the toe and at the top of the arch and into the user's arch, firmly engaging over the shoe or boot.

It is thus an object of the invention to improve on the manner of and efficiency and reliability of binding the user's boot into a snowshoe. A related object is to firmly engage the user's arch thus to increase stability and prevent rotation of the boot in the harness. These and other objects, advances, and features of the invention will be apparent from the following description of a preferred embodiment, considered along with the drawing.

DESCRIPTION OF PREFERRED EMBODIMENTS

Figure 1:
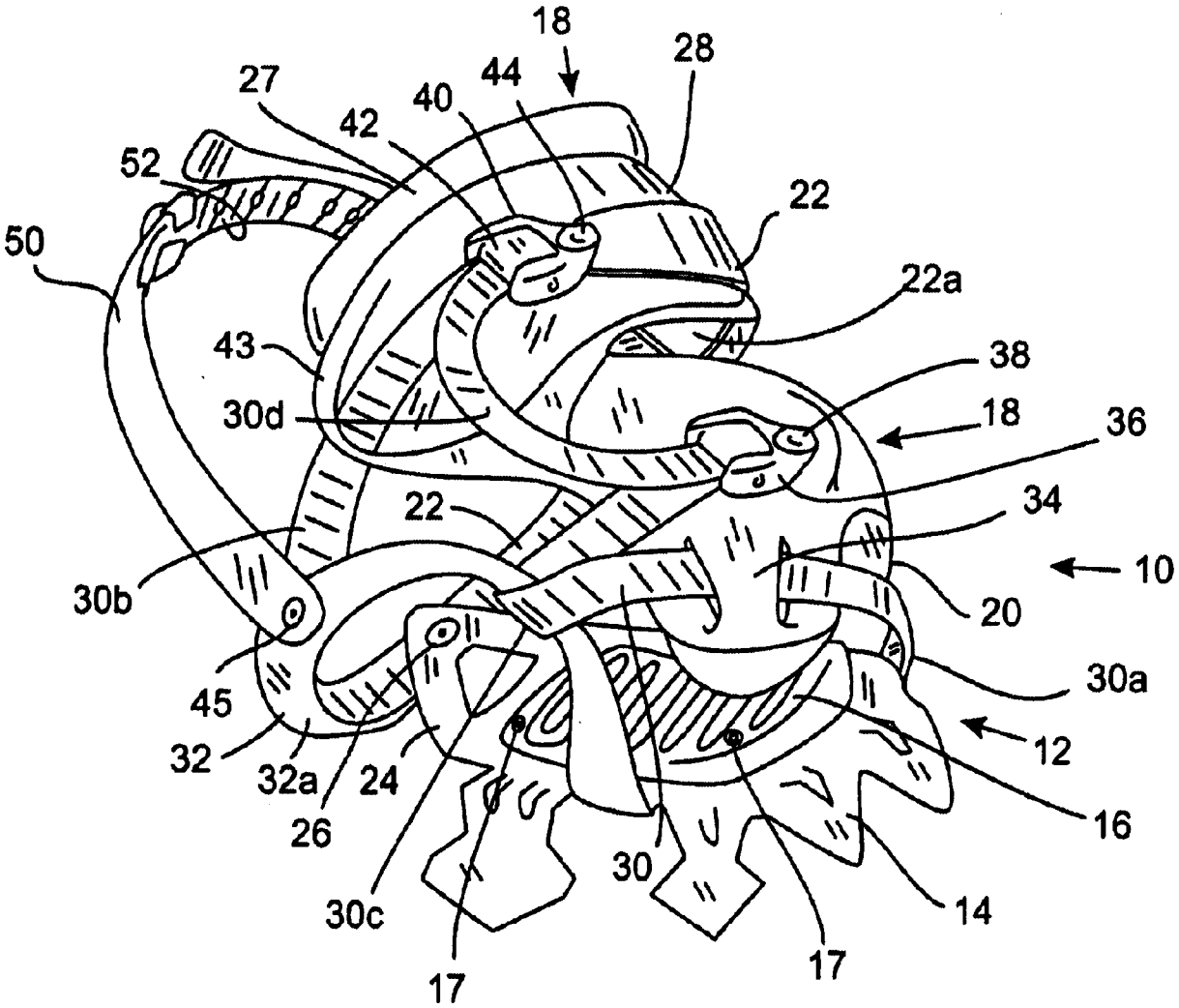
FIG. 1 is a perspective view showing a snowshoe binding apparatus embodying the invention, shown removed from a snowshoe for clarity.

In the drawings, FIG. 1 shows a snowshoe binding 10, without the snowshoe. The binding 10 includes a footbed 12 which may comprise a metal front claw 14 and a pad 16 of elastomeric material, preferably contoured to fit the bottom of a user's shoe or boot as disclosed in U.S. Pat. No. 5,687,491. The footbed 12 can be connected to a snowshoe using suspension straps, for example as shown in U.S. Pat. No. 5,687,491, the disclosure of which is incorporated herein by reference. Rivets 17 through the footbed, in front and rear locations, can be employed to secure the footbed to such suspension straps.

Depicted in FIG. 1 is a left boot binding. A harness shell 18 extends out and upwardly from the outer side of the harness (i.e., the left side of the left shoe binding). This harness shell 18 is secured to the footbed, via a front leg 20 and a rear leg or strap 22, which connects to a rear extension 24 of the metal claw 14, preferably in a pivoted connection at 26. The harness shell 18 is shaped and flexible, formed in one preferred embodiment of molded urethane and having a padding 27 at its underside, shown extending out at the back side of the shell 18, and this padding may be at EVA foam.

Although the member 18 is referred to collectively as a harness shell, it preferably comprises more than one component. An arch top shell member 28 is formed separately from the leg or strap 22, but these two components are connected together via a sliding connection. This sliding connection may be made by a loop of material extending slightly outwardly in the outer side of the shell member 28 (not visible in FIG. 1), and this is partially indicated by a portion 22*a* being visible through a cutout in the shell member where the loop of material (not shown) extends outwardly. This sliding connection or strap guide allows the shell member 28 to "float" as the binding is tightened over a user's boot. At the arch area of the shoe and of the binding, it is the strap 22, fixed to the footbed at 26, which is actually being tensioned, with the shell member 28 being moved by the strap into appropriate position but allowed to float into a comfortable and stable position by the slide connection between the strap and shell member, thus accommodating different shoe sizes and shapes. It should be understood that in this description and in the claims, a reference to a harness shell being connected to the footbed is intended to refer to what is shown and described immediately above, as well as a direct connection between a shell member and the footbed, i.e., if the strap 22 and shell member 28 were integral or fixedly secured together.

As discussed previously, the binding 10 of the invention allows a user to pull at one strap location to secure the binding at both toe and arch areas. In a preferred embodiment, a single adjustment strap 30 is included, being connected at one end 30*a* to the footbed at a forward and outer point, and at its other end 30*b* to the harness element 32, which in turn is connected to the footbed. This connection preferably is via the footbed extension 24, at a pivotal connection 26. The harness element 32 at the inner side of the binding and the strap or leg 22 at the outer side of the binding preferably are separate elements, although both are connected in this embodiment via the pivot connection 26. Both are allowed separate pivotal movement. In a modified form of the binding 10, the adjustment strap end 30*b* could be connected directly to the footbed, as at 26. References in the claims to the strap being connected to the footbed are intended to include a direct connection or an indirect connection via the harness element 32.

As shown in FIG. 1, the adjustment strap 30 preferably engages with the harness shell at one location near the front of the toe area, passing through an appropriate slide connection or strap guide such as a loop 34 in the harness shell material as shown in the drawing, this slide connection being similar to the slide connection at 22*a* for the strap 22 discussed previously. The connection at 34 allows the front portion of the harness shell 18 to "float" in position to accommodate different shoe sizes and shapes.

In this preferred embodiment, the adjustment strap 30 loops over the harness element 32 as shown, providing a slidable connection which can move forward or back as needed, again to allow floating movement of the harness shell 18 to accommodate different shoe sizes and shapes. Beyond this loop-over at 30*c* the strap 30 passes through a slip-through type locking adjustment buckle 36, and this buckle is connected to the harness shell 18, which can be by a fastener such as the rivet 38 shown, providing a pivoted connection. The loop-over provides mechanical advantage in drawing the toe strap tight, in addition to the mechanical advantage at the buckle 36.

Beyond the buckle 36, the strap 30 has a tail portion 30*d* which is actually a loop or bridge between that buckle and another buckle 40 also connected to the harness shell 18. The bridge or loop 30*d* of the strap is comprised of the tail ends of two strap sections, i.e. the forward, toe area strap section between the point 30*a* and the buckle 36, and the rear or arch area strap section between the other end 30*b* and the buckle 40. This could be two separate straps and can be considered as two straps, a toe strap and an arch strap, even in the embodiment where these are connected by continuity of the strap at 30*d*. The area 30*d* forms a handle for pulling the two strap sections tight to draw the harness shell down against the user's boot with a single pull. If the two strap sections are separate pieces, the area 30*d* can comprise some form of handle connecting both strap sections. In any event, reference to two straps, one at the toe area and one at the arch area, is intended to include the configuration shown, wherein the straps comprise one continuous strap 30.

The slip-through type adjustable locking buckles 36 and 40 in a preferred embodiment comprise a cam lock buckle, which may be generally of the type shown in co-pending application Ser. No. 09/494,324. These include a buckle lever 42 which works on a cam principle, binding more firmly into the strap when back-pulling tension in the binding is increased, but allowing for the user to pull the strap tail 30*d* in the strap-tightening direction, which has the effect of releasing the cam lock from the strap.

Beyond the buckle 40 the strap (sometimes referred to as second strap) passes through a strap guide 43 of the harness shell 18, and down to be connected with the footbed (in this case via a connection to the harness element 32, at 45.

As described above, in the illustrated preferred embodiment the harness shell 18 comprises two components, the shell member 28 and the leg or strap 22, the latter being connected to the footbed. In this case, the buckle 40 is secured (preferably by pivotal connection 44) to the end of the strap or leg 22, not to the shell member 28, and it is described herein and in some of the claims as being connected to the harness shell 18.

The harness element 32 at the inner or opposite side of the binding 10 may simply comprise a sweeping loop of material as shown, connected at the rear point 26 to the footbed and also at a forward point generally as shown, and this may be by riveting such as by several of the rivets 17 seen in FIG. 1. The configuration of the harness element 32 is important, because its rear portion 32*a* is positioned to engage against the concave arch of the user's boot or shoe, at the bottom of the arch and up the side. The firm arch engagement is important for stability of the boot in the snowshoe, preventing rotation of the boot and otherwise stably retaining the boot in place. If the harness element 32 were replaced with a solid shell piece, effective engagement of this concave arch area would not be achieved.

In the preferred embodiment, a heel strap 50 is included, and this may be connected to the harness element 32 in a pivot connection at 45 on the inner side, and to a back portion of the shell element 28 on the outer side (connection now shown). Here, adjustment and locking of the heel strap may be accomplished with another type of cam lock buckle, secured to the harness shell, the buckle being of the type shown in co-pending application Ser. No. 09/777,009. This type buckle makes a positive locking engagement with any of a series of strap holes 52 which are visible in FIG. 1.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A snowshoe binding, comprising:

a footbed for engagement against the bottom of a user's shoe or boot and adapted for securing to a snowshoe, a boot binding extending up from the footbed, with flexible means connecting a pair of slip-through type adjustment buckles to the one side of the footbed, one adjustment buckle being generally over the toe area of the boot and the other being to the rear, generally over the arch area of the boot, strap means connected to the footbed, for enabling tightening of the binding snugly over a user's boot, both over the toe area of the boot and the arch area of the boot, with a single pull on an intermediate portion of the strap means, between the two buckles.

2. The snowshoe binding of claim 1, wherein the strap means comprises a single continuous strap.

3. The snowshoe binding of claim 1, wherein the flexible means comprises a flexible harness shell extending up from the one side of the footbed and generally to a position over the top of the boot, the two buckles being secured to the flexible harness shell.

4. A snowshoe binding, comprising:

a footbed for engagement against the bottom of a user's shoe or boot and adapted for securing to a snowshoe, a boot binding extending up from the footbed, the binding at one side having a shaped, flexible harness shell adapted to engage the shoe or boot at the side and at least partially over the top of the shoe or boot, strap means and buckle means connected to the footbed and to the flexible harness shell, for enabling tightening of the harness shell snugly over a user's boot, both over the toe area of the boot and the arch area of the boot, with a single pull on an intermediate, handle portion of the strap means which is effective to draw tension in end portions of the strap means, such tension being retained in the end portions by said buckle means located at spaced positions at either side of said intermediate, handle portion of the strap means.

5. The snowshoe binding of claim 4, wherein the buckle means comprises a pair of slip-through adjustable locking buckles secured to the harness shell and ultimately to the footbed at said one side, one buckle being adjacent to the toe area of the boot as the other being over the arch area, and the intermediate portion of the strap means being between the two buckles.

6. The snowshoe binding of claim 5, wherein the strap means comprises a single continuous strap.

7. The snowshoe binding of claim 4, wherein the side of the binding opposite said one side includes a flexible harness element to which the strap means is connected, the flexible harness element being secured to the footbed and having a portion adjacent to the footbed which is positioned to firmly engage in the arch of the user's boot when the binding is tightened against the user's boot.

8. The snowshoe binding of claim 4, wherein the flexible harness shell has a padded underside for engaging against the shoe or boot.

9. The snowshoe binding of claim 7, further including a heel strap secured to the harness shell at the one side and to the flexible harness element at the other side and positioned to extend around the heel of a boot or shoe.

10. A snowshoe binding, comprising:

a footbed for engagement against the bottom of a user's shoe or boot and adapted for securing to a snowshoe, a boot binding extending up from the footbed, the binding at one side having a shaped, flexible harness shell adapted to engage the shoe or boot at the side and at least partially over the top of the shoe or boot, an opposite side of the binding having a shaped, flexible harness element connected to the footbed near front and back and extending outwardly and upwardly from the footbed, a first flexible strap fixed to the one side at the footbed, extending to the other side and looping through the flexible harness element and being slidable therethrough, then returning back toward the harness shell and being engaged in and passing through an adjustable locking buckle connected to the flexible harness shell, a second flexible strap connected at said other side to the footbed and crossing generally to a position above the arch area to a second adjustable locking buckle connected to the flexible harness shell, the two straps being connected in a grippable handle extending generally between the two buckles, and capable of being pulled up by a user to draw both straps with one pull, the tightening of the first and second straps being effective to pull the flexible harness shell and the flexible harness element into engagement against the boot.

11. The snowshoe binding of claim 1, wherein the shaped harness shell comprises a harness leg or strap to which the second adjustment buckle is fixed and an arch top shell member connected in a sliding connection with the harness leg or strap.

12. The snowshoe binding of claim 11, further including a strap guide on the arch top shell member generally at said other side of the binding, through which the second strap passes.

13. The snowshoe binding of claim 11, wherein the footbed has a rear extension, and the harness leg or strap is pivotally connected to the back of the rear extension.

14. The snowshoe binding of claim 13, wherein said harness element at said other side comprises an arch loop extending from near the front of the footbed in a sweeping arch to the back of the rear extension of the footbed and having a rear portion near said rear extension that is positioned to engage against the arch of a user's boot and foot to add stability and prevent boot rotation, said other side thus being adapted to receive the inner side of the boot and foot.

15. The snowshoe binding of claim 13, wherein the arch loop is pivotally connected to the footbed rear extension.

16. The snowshoe binding of claim 1, wherein the flexible harness shell has a padded underside for engaging against the shoe or boot.

17. The snowshoe binding of claim 16, wherein the padded underside comprises EVA foam.

18. The snowshoe binding of claim 1, wherein the harness shell is molded of urethane.

19. The snowshoe binding of claim 1, wherein the first strap loops through the flexible harness element at said other side in such a way that the first strap is slidable in a generally front to back direction, so that the position at which the strap loops over the harness element can shift, allowing the harness shell to shift, to accommodate different shoe sizes.

20. The snowshoe binding of claim 1, further including a heel strap secured to the harness shell at the one side and to the harness element at the other side and positioned to extend around the heel of a boot or shoe.

21. The snowshoe binding of claim 1, wherein the harness shell has a strap guide near its front end, through which the first strap passes in a sliding connection, to maintain stable positioning of the harness shell while allowing the harness shell to float in position to find a correct and stable position over the user's boot.

22. The snowshoe binding of claim 1, wherein the first and second straps comprise a single integral strap which is continuous from buckle to buckle.

23. A snowshoe binding, comprising:

a footbed for engagement against the bottom of a user's shoe or boot and adapted for securing to a snowshoe, a boot binding extending up from the footbed, the binding at one side having a flexible harness shell adapted to engage the shoe or boot at the side, an opposite side of the binding having a flexible harness element extending outwardly and upwardly from the footbed, and comprising an arch loop extending from near the front of the footbed in a sweeping arch to the rear of the footbed and having a rear portion near said rear of the footbed that is positioned to engage against the arch of a user's boot and foot to add stability and prevent boot rotation, said other side thus being adapted to receive the inner side of the boot and foot, a first flexible strap extending from the one side of the binding to the opposite side and looping through the arch loop and being slidable therealong and therethrough, then returning back toward the one side and being engaged in a buckle connected to the flexible harness shell, second strap means connecting said one side and said opposite side of the binding, over the user's shoe or boot rear of the first flexible strap, whereby the arch loop and the first flexible strap looping through the arch loop and being slidable along the arch loop and through the arch loop provide a flexibility in the snowshoe binding to accommodate different sizes and shapes of the shoes or boots of users.

24. The snowshoe binding of claim 23, wherein the second strap means extends generally at a position above the arch area of the user's shoe or boot.

25. The snowshoe binding of claim 24, wherein the second strap means is connected to an adjustable locking buckle connected to the flexible harness shell.

26. The snowshoe binding of claim 23, wherein the second strap means comprises a second flexible strap connected at said opposite side to the arch loop and crossing generally to a position above the arch area of the shoe or boot to an adjustable locking buckle connected to the flexible harness shell.

* * * * *

UNITED STATES PATENT AND TRADEMARK OFFICE

CERTIFICATE OF CORRECTION

PATENT NO. : 6,694,646 B2
DATED : February 24, 2004
INVENTOR(S) : Nathan J. Messmer et al.

It is certified that error appears in the above-identified patent and that said Letters Patent is hereby corrected as shown below:

Column 5,
Line 41, claim 11 should read:

11. The snowshoe binding of claim 10, wherein the shaped harness shell comprises a harness leg or strap to which the second adjustment buckle is fixed and an arch top shell member connected in a sliding connection with the harness leg or strap.

Line 63, claim 16 should read:

16. The snowshoe binding of claim 10, wherein the flexible harness shell has a padded underside for engaging against the shoe or boot.

Column 6,
Line 1, claim 18 should read:

18. The snowshoe binding of claim 10, wherein the harness shell is molded of urethane.

Line 3, claim 19 should read:

19. The snowshoe binding of claim 10, wherein the first strap loops through the flexible harness element at said other side in such a way that the first strap is slidable in a generally front to back direction, so that the position at which the strap loops over the harness element can shift, allowing the harness shell to shift, to accommodate different shoe sizes.

Line 9, claim 20 should read:

20. The snowshoe binding of claim 10, further including a heel strap secured to the harness shell at one side and to the harness element at the other side and positioned to extend around the heel of a boot or shoe.

Line 13, claim 21 should read:

21. The snowshoe binding of claim 10, wherein the harness shell has a strap guide near its front end, through which the first strap passes in a sliding connection, to maintain stable positioning of the harness shell while allowing the harness shell to float in position to find a correct and stable position over the user's boot.

UNITED STATES PATENT AND TRADEMARK OFFICE

CERTIFICATE OF CORRECTION

PATENT NO. : 6,694,646 B2
DATED : February 24, 2004
INVENTOR(S) : Nathan J. Messmer et al.

It is certified that error appears in the above-identified patent and that said Letters Patent is hereby corrected as shown below:

Column 6 (cont'd),
Line 19, claim 22 should read:

22. The snowshoe binding of claim 10, wherein the first and second straps comprise a single integral strap which is continuous from buckle to buckle.

Signed and Sealed this

Twenty-eighth Day of March, 2006

JON W. DUDAS
*Director of the United States Patent and Trademark Office*